US011913168B2

(12) United States Patent
Habraken et al.

(10) Patent No.: US 11,913,168 B2
(45) Date of Patent: Feb. 27, 2024

(54) PROCESS FOR PRODUCING DYED MIXED FIBRES, DYED MIXED FIBRE YARNS AND/OR DYED MIXED FIBRE TEXTILE FABRICS

(71) Applicant: BASF SE, Ludwigshafen am Rhein (DE)

(72) Inventors: Gijsbrecht Jacobus Maria Habraken, Ludwigshafen am Rhein (DE); Klaus Scheuermann, Ludwigshafen am Rhein (DE); Achim Loeffler, Ludwigshafen am Rhein (DE)

(73) Assignee: BASF SE, Ludwigshafen am Rhein (DE)

( * ) Notice: Subject to any disclaimer, the term of this patent is extended or adjusted under 35 U.S.C. 154(b) by 156 days.

(21) Appl. No.: 17/761,606

(22) PCT Filed: Sep. 17, 2020

(86) PCT No.: PCT/EP2020/076006
§ 371 (c)(1),
(2) Date: Mar. 18, 2022

(87) PCT Pub. No.: WO2021/053085
PCT Pub. Date: Mar. 25, 2021

(65) Prior Publication Data

US 2022/0372699 A1 Nov. 24, 2022

(30) Foreign Application Priority Data

Sep. 20, 2019 (EP) ..... 19198566

(51) Int. Cl.

| | |
|---|---|
| ***D06P 1/00*** | (2006.01) |
| ***D01F 1/10*** | (2006.01) |
| ***D01F 6/92*** | (2006.01) |
| ***D06P 1/16*** | (2006.01) |
| ***D06P 3/14*** | (2006.01) |
| ***D06P 3/54*** | (2006.01) |

(52) U.S. Cl.
CPC ..... *D06P 1/16* (2013.01); *D01F 1/10* (2013.01); *D01F 6/92* (2013.01); *D06P 3/143* (2013.01); *D06P 3/54* (2013.01); *D10B 2201/02* (2013.01); *D10B 2211/02* (2013.01); *D10B 2331/04* (2013.01); *D10B 2401/14* (2013.01)

(58) Field of Classification Search
CPC .... D06P 1/16; D06P 3/143; D06P 3/54; D06P 3/16; D06P 3/18; D06P 3/241; D06P 3/242; D06P 3/6025; D06P 3/8238; D06P 3/8242; D06P 3/8247; D06P 3/8214; D01F 1/10; D01F 6/92; D10B 2201/02; D10B 2211/02; D10B 2331/04; D10B 2401/14; D02G 3/04
USPC ..... 8/494
See application file for complete search history.

(56) References Cited

U.S. PATENT DOCUMENTS

| | | | | |
|---|---|---|---|---|
| 2003/0055206 | A1 | 3/2003 | Haile et al. | |
| 2012/0180232 | A1 * | 7/2012 | Baum | D01F 6/92 8/494 |

FOREIGN PATENT DOCUMENTS

| | | | | |
|---|---|---|---|---|
| CA | 2767371 | A1 * | 2/2011 | D01F 6/92 |
| CN | 106835437 | A | 6/2017 | |
| WO | WO 2018219714 | A1 * | 12/2018 | D01F 6/92 |

OTHER PUBLICATIONS

International Search Report and Written Opinion received for PCT Patent Application No. PCT/EP2020/076006, dated Dec. 4, 2020, 8 pages.

* cited by examiner

*Primary Examiner* — Eisa B Elhilo
(74) *Attorney, Agent, or Firm* — Faegre Drinker Biddle & Reath LLP

(57) ABSTRACT

The present invention relates to a process for producing dyed mixed fibres (D-MF), dyed mixed fibre yarns (D-MY) and/or dyed mixed fibre textile fabrics (D-MT) in which mixed fibres (MF), mixed fibre yarns (MY) and/or mixed fibre textile fabrics (MT) comprising at least one polyester fibre (PF) and at least one further fibre (FF) are simultaneously contacted with at least two different dyes (D1) and (D2) at a temperature $T_D$<130° C. The at least one polyester fibre (PF) comprises 80 to 99.5% by weight of at least one terephthalate polyester (A), 0.5 to 20% by weight of at least one aliphatic-aromatic polyester (B) and 0 to 5% by weight of at least one additive (C), wherein the % by weight are based in each case on the total weight of components (A), (B) and optionally (C). Moreover, the present invention relates to the dyed mixed fibres (D-MF), the dyed mixed fibre yarns (D-MY) and/or the dyed mixed fibre textile fabrics (D-MT) obtained by this process.

15 Claims, No Drawings

PROCESS FOR PRODUCING DYED MIXED FIBRES, DYED MIXED FIBRE YARNS AND/OR DYED MIXED FIBRE TEXTILE FABRICS

CROSS-REFERENCE TO RELATED APPLICATIONS

This application is a national stage application (under 35 U.S.C. § 371) of PCT/EP2020/076006, filed Sep. 17, 2020, which claims benefit of European Application No. 19198566.2, filed Sep. 20, 2019, both of which are incorporated herein by reference in their entirety.

The present invention relates to a process for producing dyed mixed fibres (D-MF), dyed mixed fibre yarns (D-MY) and/or dyed mixed fibre textile fabrics (D-MT) in which mixed fibres (MF), mixed fibre yarns (MY) and/or mixed fibre textile fabrics (MT) comprising at least one polyester fibre (PF) and at least one further fibre (FF) are simultaneously contacted with at least two different dyes (D1) and (D2) at a temperature $T_D$<130° C. The at least one polyester fibre (PF) comprises 80 to 99.5% by weight of at least one terephthalate polyester (A), 0.5 to 20% by weight of at least one aliphatic-aromatic polyester (B) and 0 to 5% by weight of at least one additive (C), wherein the % by weight are based in each case on the total weight of components (A), (B) and optionally (C). Moreover, the present invention relates to the dyed mixed fibres (D-MF), the dyed mixed fibre yarns (D-MY) and/or the dyed mixed fibre textile fabrics (D-MT) obtained by this process.

Polyesters are generally polymers having ester functions —[—CO—O—]— in their main chain. They are typically prepared by ring-opening polymerization of lactones or by polycondensation of hydroxycarboxylic acids or of diols and dicarboxylic acids/dicarboxylic acid derivatives. Of particular importance are the aromatic polyesters which, in the form of polyester fibres, find use in the textile industry.

Polyester fibres as well as the yarns and textile fabrics made therefrom are typically dyed with disperse dyes which are relatively expensive, compared, for example, to direct dyes. The dyeing is usually performed either by the exhaust process or the thermosol process, wherein the disperse dyes diffuse into the fibres. In the exhaust process, the polyester fibres (or the yarns and textile fabrics made therefrom) are contacted with a bath which comprises the disperse dye and usually has a temperature of 130° C. or more. In the thermosol process, the polyester fibres (or the yarns and textile fabrics made therefrom) are usually impregnated with a dispersion which comprises the disperse dye. After impregnation, the polyester fibres (or the yarns and textile fabrics made therefrom) are inter-dried at a temperature of 100° C. and then subjected to a heat treatment with hot air at a temperature of 180 to 200° C. for 30 to 60 seconds.

However, in case the polyester fibres (or the yarns and textile fabrics made therefrom) are in the form of mixed fibres (or mixed fibre yarns or mixed fibre textile fabrics), which means that they also comprise further fibres different from polyester fibres, the high pressure and the high temperature of more than 130° C. become a major problem since the further fibres can be destroyed at such high pressure and temperature. For example, at temperatures of 130° C., wool fibres and acrylic fibres are thermally decomposed. Therefore, to avoid the destruction of fibres, the different fibres are typically dyed in at least two separate steps and can only afterwards be mixed and further processed into mixed fibre yarns or mixed fibre textile fabrics.

Furthermore, it is also not possible to dye all fibres with disperse dyes: Wool fibres, cotton fibres or viscose fibres, for example, are only dyeable with direct dyes. Thus, if both the polyester fibres and the further fibres are to be dyed, the different fibres are also either dyed in at least two separate steps or the already mixed fibres (or mixed fibre yarns or mixed fibre textile fabrics) are dyed in at least two different baths. The same holds true if the polyester fibres are to be dyed in a colour which is different from the colour of the further fibres.

As a result, the dyeing process of mixed fibres, mixed fibre yarns and mixed fibre textile fabrics is very energy- and time-consuming, and, consequently, very cost-intensive.

Therefore, there is a need for an improved, inexpensive process for producing dyed mixed fibres, dyed mixed fibre yarns and dyed mixed fibre textile fabrics which show good mechanical properties as well as a high light- and washfastness.

It is hence an object of the present invention to provide an improved process for producing dyed mixed fibres, dyed mixed fibre yarns and dyed mixed fibre textile fabrics which can preferably be carried out at temperatures below 130° C. The dyed mixed fibres, yarns and textile fabrics thus obtained should show good mechanical properties as well as a high light- and washfastness. The process of the invention and the dyed mixed fibres, dyed mixed fibre yarns and dyed mixed fibre textile fabrics obtained thereby are to have the disadvantages of the processes described in the prior art and of the dyed mixed fibres, dyed mixed fibre yarns and dyed mixed fibre textile fabrics obtainable therefrom only to a reduced degree, if at all. The process of the invention is to be simple, have a minimum susceptibility to faults and be performable inexpensively.

This object is achieved by a process for producing dyed mixed fibres (D-MF), dyed mixed fibre yarns (D-MY) and/or dyed mixed fibre textile fabrics (D-MT) comprising the following steps a) to d)

a) providing at least one polyester fibre (PF) comprising
   - 80 to 99.5% by weight of at least one terephthalate polyester (A),
   - 0.5 to 20% by weight of at least one aliphatic-aromatic polyester (B) obtainable by polymerization of at least the following monomers:
     - (m1) at least one aliphatic 1,ω-diol,
     - (m2) at least one aliphatic 1,ω-dicarboxylic acid compound and
     - (m3) at least one aromatic 1,ω-dicarboxylic acid compound, and
   - 0 to 5% by weight of at least one additive (C),
   - wherein the % by weight are based in each case on the total weight of components (A), (B) and optionally (C),
b) providing at least one further fibre (FF) different from the at least one polyester fibre (PF),
c) processing the at least one polyester fibre (PF) and the at least one further fibre (FF) to obtain mixed fibres (MF), mixed fibre yarns (MY) and/or mixed fibre textile fabrics (MT), wherein the mixed fibres (MF), the mixed fibre yarns (MY) and the mixed fibre textile fabrics (MT) comprise the at least one polyester fibre (PF) and the at least one further fibre (FF), and
d) contacting the mixed fibres (MF), the mixed fibre yarns (MY) and/or the mixed fibre textile fabrics (MT) simultaneously with at least two different dyes (D1) and (D2) at a temperature $T_D$<130° C. to obtain dyed mixed fibres (D-MF), dyed mixed fibre yarns (D-MY) and/or dyed mixed fibre textile fabrics (D-MT).

It has surprisingly been found that by the inventive process mixed fibres (MF), mixed fibre yarns (MY) and mixed fibre textile fabrics (MT) which comprise at least one polyester fibre (PF) and at least one further fibre (FF) can be dyed simultaneously with at least two different dyes (D1) and (D2) in one step at a temperature $T_D$<130° C., preferably at a temperature $T_D$<110° C. and more preferably at a temperature $T_D$<100° C.

The inventive process makes it possible to dye mixed fibres (MF), mixed fibre yarns (MY) and mixed fibre textile fabrics (MT) which, for example, comprise at least one wool or at least one acrylic fibre as further fibre (FF) without destroying them. The inventive process makes it also possible to dye the at least one polyester fibre (PF) in a colour different from the colour of the at least one further fibre (FF) simultaneously and by only using one step.

In summary, by the inventive process, operating costs and environmental burden are lowered by reduction of energy and time consumption.

Surprisingly, the dyed mixed fibres (D-MF), dyed mixed fibre yarns (D-MY) and dyed mixed fibre textile fabrics (D-MT) obtained by the inventive process also show a high light- and washfastness. Further, the inventive process is gentle on the mixed fibres (MF), the mixed fibre yarns (MY) and the mixed fibre textile fabrics (MT): The dyed mixed fibres (D-MF), dyed mixed fibre yarns (D-MY) and dyed mixed fibre textile fabrics (D-MT) obtained are as supple and smooth as before dyeing.

Moreover, the dyed mixed fibres (D-MF), dyed mixed fibre yarns (D-MY) and dyed mixed fibre textile fabrics (D-MT) obtained by the inventive process exhibit good mechanical properties like a high elongation and a high modulus of elasticity.

The invention is specified in more detail as follows:

Step a)

In step a) of the process for producing dyed mixed fibres (D-MF), dyed mixed fibre yarns (D-MY) and/or dyed mixed fibre textile fabrics (D-MT), at least one polyester fibre (PF) is provided.

The terms "at least one polyester fibre (PF)", "polyester fibre (PF)" and "polyester fibre" are used synonymously in the context of the present invention and have the same meaning. Furthermore, in the context of the present invention, the term "at least one polyester fibre (PF)" is understood to mean exactly one polyester fibre (PF) and mixtures of two or more polyester fibres (PF). In a preferred embodiment, mixtures of two or more polyester fibres (PF) are used in the process of the invention.

In one embodiment, in step a) at least 1% by weight, more preferably at least 5% by weight, most preferably at least 10% by weight and especially preferably at least 20% by weight of the at least one polyester fibre (PF) are provided, based in each case on the total weight of the at least one polyester fibre (PF) and the at least one further fibre (FF).

In a further embodiment, in step a) at most 99% by weight, more preferably at most 95% by weight, most preferably at most 90% by weight and especially preferably at most 80% by weight of the at least one polyester fibre (PF) are provided, based in each case on the total weight of the at least one polyester fibre (PF) and the at least one further fibre (FF).

Preferably, in step a) 1 to 99% by weight, more preferably 5 to 95% by weight, most preferably 10 to 90% by weight and especially preferably 20 to 80% by weight of the at least one polyester fibre (PF) are provided, based in each case on the total weight of the at least one polyester fibre (PF) and the at least one further fibre (FF).

Polyester Fibre (PF)

The at least one polyester fibre (PF) comprises 80 to 99.5% by weight of at least one terephthalate polyester (A), 0.5 to 20% by weight of at least one aliphatic-aromatic polyester (B) obtainable by polymerization of at least the following monomers:

(m1) at least one aliphatic 1,ω-diol, (m2) at least one aliphatic 1,ω-dicarboxylic acid compound and (m3) at least one aromatic 1,ω-dicarboxylic acid compound, and 0 to 5% by weight of at least one additive (C), wherein the % by weight are based in each case on the total weight of components (A), (B) and optionally (C), preferably based on the total weight of the at least one polyester fibre (PF).

Component (A)

Component (A) is at least one terephthalate polyester.

In the process for producing dyed mixed fibres (D-MF), dyed mixed fibre yarns (D-MY) and/or dyed mixed fibre textile fabrics (D-MT) the amount of the at least one terephthalate polyester (A) comprised in the at least one polyester fibre (PF) is generally in the range of 80 to 99.5% by weight, preferably in the range of 85 to 95% by weight, based on the total weight of the components (A), (B) and optionally (C) comprised in the at least one polyester fibre (PF), preferably based on the total weight of the at least one polyester fibre (PF).

The terms "at least one terephthalate polyester (A)", "terephthalate polyester (A)", "terephthalate polyester" and "component (A)" are used synonymously in the context of the present invention and have the same meaning. Furthermore, in the context of the present invention, the term "at least one terephthalate polyester (A)" is understood to mean exactly one terephthalate polyester (A) and mixtures of two or more terephthalate polyesters (A). In a preferred embodiment, exactly one terephthalate polyester (A) is used in the process of the invention.

The terephthalate polyester (A) can be prepared by all methods known to those skilled in the art. In a preferred embodiment, the terephthalate polyester (A) is prepared by polycondensation of diols, terephthalic acid compounds and optionally isophthalic acid compounds. The terephthalate polyester (A) and the aliphatic-aromatic polyester (B) are different compounds. For the production of the terephthalate polyester (A) generally, compared to the production of the aliphatic-aromatic polyester (B), a lower amount of the aliphatic 1,ω-dicarboxylic acid compound is used. In a preferred embodiment for the production of the terephthalate polyester (A) no aliphatic 1,ω-dicarboxylic acid compound is used.

In a preferred embodiment the at least one terephthalate polyester (A) is obtainable by polymerization of at least the following monomers:

(n1) at least one aliphatic 1,ω-diol, and (n2) at least one terephthalate acid compound.

In an even more preferred embodiment, the at least one terephthalate polyester (A) is obtainable by polymerization of the following monomers:

(n1) at least one aliphatic 1,ω-diol, (n2) at least one terephthalate acid compound, and (n3) optionally at least one isophthalic acid compound.

Component (n1) is at least one aliphatic 1,ω-diol.

The terms "at least one aliphatic 1,ω-diol (n1)", "aliphatic 1,ω-diol (n1)", "aliphatic 1,ω-diol" and "component (n1)" are used synonymously in the context of the present invention and have the same meaning. In addition, in the context of the present invention, the term "at least one aliphatic 1,ω-diol (n1)" is understood to be exactly one aliphatic 1,ω-diol (n1) and mixtures of two or more aliphatic 1,ω-diols (n1). In a preferred embodiment, in the process of the invention, exactly one aliphatic 1,ω-diol (n1) is used.

The aliphatic 1,ω-diol (n1) can be linear, branched or cyclic. Moreover, the aliphatic 1,ω-diol (n1) can be saturated, joined by single bonds (alkanes), or unsaturated, with double bonds (alkenes) or triple bonds (alkynes). Moreover the aliphatic 1,ω-diol (n1) can contain hetero atoms like oxygen or sulfur substituting one or more carbon atoms of the carbon backbone.

In the context of the present invention, the aliphatic 1,ω-diol (n1) is preferably an aliphatic 1,ω-diol having 2 to 12, preferably having 2 to 6, more preferably 2 to 4 carbon atoms.

Examples of aliphatic 1,ω-diols (n1) are ethylene glycol (ethane-1,2-diol), propane-1,3-diol, butane-1,4-diol, pentane-1,5-diol, hexane-1,6-diol, diethylene glycol, triethylene glycol, 2-methyl-1,3-propanediol, 2-ethyl-1,3-propanediol, 2,2-dimethylpropane-1,3-diol, 2-methyl-1,4-butanediol, 2-ethyl-2-butylpropane-1,3-diol, 2-ethyl-2-isobutylpropane-1,3-diol, 1,4-cyclohexandiol, cyclohexane-1,4-dimethanol or 2,2,4-trimethylhexane-1,6-diol.

Particularly preferred aliphatic 1,ω-diols (n1) are ethylene glycol, propane-1,3-diol or butane-1,4-diol, most preferably ethylene glycol. Preferably the component (n1) used for the preparation of the terephthalate polyester (A) consists of at least 95% by weight, preferably of at least 98% by weight of an diol selected from the group consisting of ethylene glycol, propane-1,3-diol and butane-1,4-diol and 0 to 5% by weight, preferably of 0 to 2% by weight of at least one further diol selected from the group consisting of cyclic aliphatic diols and diethylene glycol.

Component (n2) is at least one terephthalic acid compound.

The terms "at least one terephtalic acid compound (n2)", "terephtalic acid compound (n2)", "terephtalic acid compound" and "component (n2)" are used synonymously in the context of the present invention and have the same meaning. In addition, in the context of the present invention, the term "at least one terephthalic acid compound (n2)" is understood to be exactly one terephthalic acid compound (n2) and mixtures of two or more terephthalic acid compounds (n2). In a preferred embodiment, in the process of the invention, exactly one terephthalic acid compound (n2) is used. The same holds true for the optional isophtalic acid compound (n3), respectively.

In the context of the present invention, the terephthalic acid compound (n2) is understood to mean terephthalic acid itself and derivatives of terephthalic acid, such as terephthalic esters. Useful terephthalic esters here include the di-$C_1$-$C_6$-alkyl esters of terephthalic acid, for example the dimethyl, diethyl, di-n-propyl, diisopropyl, di-n-butyl, diisobutyl, di-t-butyl, di-n-pentyl, diisopentyl or di-n-hexyl esters of terephthalic acid. The same holds true for the optional isophtalic acid compound (n3), respectively.

The terephthalic acid or derivatives thereof may be used individually or as a mixture of two or more thereof. In view of component (n2) particular preference is given to using terephthalic acid or dimethyl terephthalate.

In view of the optionally used component (n3) particular preference is given to using isophthalic acid, dimethyl isophthalate, 5-sulfoisophthalic acid mono sodium salt or dimethyl 5-sulfoisophthalate mono sodium salt.

In a preferred embodiment the at least on terephthalate polyester (A) is at least one polyester selected from the group consisting of polyethylene terephthalate (PET), polytrimethylene terephthalate (PTT) and polybutylene terephthalate (PBT).

The present invention thus also provides a process in which the at least one terephthalate polyester (A) is at least one polyester selected from the group consisting of polyethylene terephthalate (PET), polytrimethylene terephthalate (PTT) and polybutylene terephthalate (PBT).

In the context of the present invention PET, in a preferred embodiment, is understood to mean a polyester that contains at least 95% by mol of repetition units derived from the above defined terephthalic acid compounds (n2) and ethylene glycol (n1), wherein the polyester may optionally contain 0 to 5% by mol of further repetition units, based on the total number of mols of repetition units contained in the polyester. The further repetition units contained in the PET may be derived from the above defined components (n3) and the above mentioned components (n1) different from ethylene glycol.

In the context of the present invention PTT, in a preferred embodiment, is understood to mean a polyester that contains at least 65% by mol, preferably at least 80% by mol, more preferably at least 90% by mol and most preferably at least 95% by mol of repetition units derived from the above defined terephthalic acid compounds (n2) and propane-1,3-diol (n1), wherein the polyester may optionally contain 0 to 35% by mol, preferably 0 to 20% by mol, more preferably 0 to 10% by mol and most preferably 0 to 5% by mol of further repetition units, based on the total number of mols of repetition units contained in the polyester. The further repetition units contained in the PTT may be derived from the above defined components (n3) and the above mentioned components (n1) different from propane-1,3-diol.

In the context of the present invention PBT, in a preferred embodiment, is understood to mean a polyester that contains at least 65% by mol, preferably at least 80% by mol, more preferably at least 90% by mol and most preferably at least 95% by mol of repetition units derived from the above defined terephthalic acid compounds (n2) and butane-1,4-diol (n1), wherein the polyester may optionally contain 0 to 35% by mol, preferably 0 to 20% by mol, more preferably 0 to 10% by mol and most preferably 0 to 5% by mol of further repetition units, based on the total number of mols of repetition units contained in the polyester. The further repetition units contained in the PBT may be derived from the above defined components (n3) and the above mentioned components (n1) different from butane-1,4-diol.

Suitable polyethylene terephthalates (PET) are for example available from the manufacturer Indorama ventures under the trade name RAMAPET. Moreover, recycled polyethylene terephthalates (PET), for example from the recycling of plastic bottles (bottle grade PET) or for example from post-consumer fibres and post-industrial fibre waste, are suitable.

Suitable polytrimethylene terephthalates (PTT) are for example available from the manufacturer DuPont under the trade name Sorona. Moreover, recycled poltrimethylene terephthalates (PTT), for example from post-consumer fibres and post-industrial fibre waste, are suitable.

Suitable polybutylene terephthalates (PBT) are for example available from the manufacturer BASF SE under the trade name Ultradur® B 2550. Moreover, recycled polybutylene terephthalates (PBT), for example from post-industrial fibres, are suitable.

The polyethylene terephthalate (PET) especially preferred in accordance with the invention as terephthalate polyester (A) generally has a melting temperature ($T_M$) in the range from 220 to 280° C., preferably in the range from 230 to 270° C., determined by differential dynamic calorimetry (differential scanning calorimetry; DSC) at a heating and cooling rate of 10° C./min.

The polytrimethylene terephthalate (PTT) especially preferred in accordance with the invention as terephthalate polyester (A) generally has a melting temperature ($T_M$) in the range from 205 to 255° C., preferably in the range from 215 to 250° C., determined by differential dynamic calorimetry (differential scanning calorimetry; DSC) at a heating and cooling rate of 10° C./min.

The polybutylene terephthalate (PBT) preferred in accordance with the invention as terephthalate polyester (A) generally has a melting temperature ($T_M$) in the range from 180 to 250° C., preferably in the range from 210 to 240° C., determined by differential dynamic calorimetry (differential scanning calorimetry; DSC) at a heating and cooling rate of 10° C./min.

Preferably the terephthalate polyester (A) is a polyester selected from polyethylene terephthalate (PET) and polytrimethylene terephthalate (PTT). A particularly preferred terephthalate polyester (A) is polyethylene terephthalate (PET).

For the preparation of the at least one terephthalate polyester (A) used in accordance with the invention, typical reaction conditions and catalysts are known in principle to those skilled in the art.

Component (B)

Component (B) is at least one aliphatic-aromatic polyester.

In the process for producing dyed mixed fibres (D-MF), dyed mixed fibre yarns (D-MY) and/or dyed mixed fibre textile fabrics (D-MT) the amount of the at least one aliphatic-aromatic polyester (B) comprised in the at least one polyester fibre (PF) is generally in the range of 0.5 to 20% by weight, preferably in the range of 5 to 15% by weight, based on the total weight of the components (A), (B) and optionally (C) comprised in the at least one polyester fibre (PF), preferably based on the total weight of the at least one polyester fibre (PF).

The terms "at least one aliphatic-aromatic polyester (B)", "aliphatic-aromatic polyester (B)", "aliphatic-aromatic polyester" and "component (B)" are used synonymously in the context of the present invention and have the same meaning. Furthermore, in the context of the present invention, the term "at least one aliphatic-aromatic polyester (B)" is understood to mean exactly one aliphatic-aromatic polyester (B) and mixtures of two or more aliphatic-aromatic polyesters (B). In a preferred embodiment, in the process of the invention, exactly one aliphatic-aromatic polyester (B) is used.

The at least one aliphatic-aromatic polyester (B) is obtainable by polymerization of at least the following monomers:

(m1) at least one aliphatic 1,ω-diol, (m2) at least one aliphatic 1,ω-dicarboxylic acid compound, and (m3) at least on aromatic 1,ω-dicarboxylic acid compound.

Component (m1)

Component (m1) is at least one aliphatic 1,ω-diol.

The terms "at least one aliphatic 1,ω-diol (m1)", "aliphatic 1,ω-diol (m1)", "aliphatic 1,ω-diol" and "component (m1)" are used synonymously in the context of the present invention and have the same meaning. In addition, in the context of the present invention, the term "at least one aliphatic 1,ω-diol (m1)" is understood to be exactly one aliphatic 1,ω-diol (m1) and mixtures of two or more aliphatic 1,ω-diols (m1). In a preferred embodiment, in the process of the invention, exactly one aliphatic 1,ω-diol (m1) is used.

Aliphatic 1,ω-diols are known in principle to those skilled in the art.

Examples of aliphatic 1,ω-diols (m1) are ethylene glycol, propane-1,3-diol, butane-1,4-diol, pentane-1,5-diol, hexane-1,6-diol, 2,2-dimethylpropane-1,3-diol, 2-ethyl-2-butylpropane-1,3-diol, 2-ethyl-2-isobutylpropane-1,3-diol, cyclohexane-1,4-dimethanol, $C_{36}$-diol with CAS no. 147853-32-5 or 2,2,4-trimethylhexane-1,6-diol.

In the context of the present invention, the aliphatic 1,ω-diol (m1) is preferably an aliphatic 1,ω-diol having 2 to 12, preferably having 4 to 6, carbon atoms. The aliphatic 1,ω-diol (m1) may be linear or branched.

Particularly preferred aliphatic 1,ω-diols (m1) are ethylene glycol, propane-1,3-diol or butane-1,4-diol, most preferably butane-1,4-diol.

The present invention thus also provides a process in which the at least one aliphatic 1,ω-diol (m1) is butane-1,4-diol.

Component (m2)

Component (m2) is at least one aliphatic 1,ω-dicarboxylic acid compound.

The terms "at least one aliphatic 1,ω-dicarboxylic acid compound (m2)", "aliphatic 1,ω-dicarboxylic acid compound (m2)", "aliphatic 1,ω-dicarboxylic acid compound" and "component (m2)" are used synonymously in the context of the present invention and have the same meaning. In addition, in the context of the present invention, the term at "least one aliphatic 1,ω-dicarboxylic acid compound (m2)" is understood to mean exactly one aliphatic 1,ω-dicarboxylic acid compound (m2) and mixtures of two or more aliphatic 1,ω-dicarboxylic acid compounds (m2). In a preferred embodiment, in the process of the invention, exactly one aliphatic 1,ω-dicarboxylic acid compound (m2) is used.

Aliphatic 1,ω-dicarboxylic acid compounds are known in principle to those skilled in the art.

In the context of the present invention, aliphatic 1,ω-dicarboxylic acid compound (m2) is understood to mean aliphatic 1,ω-dicarboxylic acid itself and derivatives of 1,ω-dicarboxylic acid, such as 1,ω-dicarboxylic acid esters. Useful 1,ω-dicarboxylic acid esters here include the di-$C_1$-$C_6$-alkyl esters of 1,ω-dicarboxylic acid, for example the dimethyl, diethyl, di-n-propyl, diisopropyl, di-n-butyl, diisobutyl, di-t-butyl, di-n-pentyl, diisopentyl or di-n-hexyl esters of 1,ω-dicarboxylic acid.

In the context of the present invention, the aliphatic 1,ω-dicarboxylic acid compound (m2) is preferably an aliphatic 1,ω-dicarboxylic acid having 2 to 40, preferably having 4 to 17, carbon atoms. The aliphatic 1,ω-dicarboxylic acid compound (m2) may be linear, branched or cyclic.

Examples of aliphatic 1,ω-dicarboxylic acids (m2) are malonic acid, succinic acid, 2-methylsuccinic acid, glutaric acid, 2-methylglutaric acid, 3-methylglutaric acid, adipic acid, pimelic acid, suberic acid, azelaic acid, sebacic acid, undecanedioic acid, dodecanedioic acid, brassylic acid, tetradecanedioic acid, fumaric acid, 2,2-dimethylglutaric acid, dimer fatty acid (for example EMPOL® 1061 from Cognis), cyclopentane-1,3-dicarboxylic acid, diglycolic acid, itaconic acid, maleic acid or norbornene-2,5-dicarboxylic acid.

Particularly preferred aliphatic 1,ω-dicarboxylic acids m2) are succinic acid, glutaric acid, adipic acid, azelaic acid, sebacic acid or brassylic acid, most preferably succinic acid, adipic acid or sebacic acid.

The present invention thus also provides a process in which the at least one aliphatic 1,ω-dicarboxylic acid compound (m2) is selected from the group consisting of succinic acid, adipic acid and sebacic acid.

Examples of esters of aliphatic 1,ω-dicarboxylic acids (m2) are preferably dimethyl esters of the aforementioned 1,ω-dicarboxylic acids (m2).

In this case, the esters of the abovementioned aliphatic 1,ω-dicarboxylic acids may be used individually or else as a mixture of two or more esters of the aliphatic 1,ω-dicarboxylic acids.

In addition, it is also possible to use a mixture of at least one aliphatic 1,ω-dicarboxylic acid and at least one ester of an aliphatic 1,ω-dicarboxylic acid.

Component (m3)

Component (m3) is at least one aromatic 1,ω-dicarboxylic acid compound.

The terms "at least one aromatic 1,ω-dicarboxylic acid compound (m3)", "aromatic 1,ω-dicarboxylic acid compound (m3)", "aromatic 1,ω-dicarboxylic acid compound" and "component (m3)" are used synonymously in the context of the present invention and have the same meaning. In addition, in the context of the present invention, the term "at least one aromatic 1,ω-dicarboxylic acid compound (m3)" is understood to mean exactly one aromatic 1,ω-dicarboxylic acid compound (m3) and mixtures of two or more aromatic 1,ω-dicarboxylic acids compounds (m3). In a preferred embodiment, in the process of the invention, exactly one aromatic 1,ω-dicarboxylic acid compound (m3) is used.

Aromatic 1,ω-dicarboxylic acids compounds (m3) in the context of the present invention are understood to mean the aromatic 1,ω-dicarboxylic acids themselves and derivatives of the aromatic 1,ω-dicarboxylic acids, such as aromatic 1,ω-dicarboxylic esters. Useful esters of the aromatic 1,ω-dicarboxylic acids here include the di-$C_1$-$C_6$-alkyl esters of the aromatic 1,ω-dicarboxylic acids, for example the dimethyl, diethyl, di-n-propyl, diisopropyl, di-n-butyl, diisobutyl, di-t-butyl, di-n-pentyl, diisopentyl or di-n-hexyl esters of the aromatic 1,ω-dicarboxylic acids.

Examples of aromatic 1,ω-dicarboxylic acid compounds (m3) are terephthalic acid, furandicarboxylic acid, isophthalic acid, 2,6-naphthoic acid or 1,5-naphthoic acid.

In the context of the present invention, the aromatic 1,ω-dicarboxylic acid compound (m3) is preferably an aromatic 1,ω-dicarboxylic acid having 6 to 12, preferably one having 6 to 8 carbon atoms, more preferably one having 8 carbon atoms. In a preferred embodiment of the present invention, the aromatic 1,ω-dicarboxylic acid compound (m3) is terephthalic acid or dimethyl terephthalate.

The present invention thus also provides a process in which the at least one aromatic 1,ω-dicarboxylic acid compound (m3) is terephthalic acid or dimethyl terephthalate.

It will be apparent that it is also possible to use the esters of the abovementioned aromatic 1,ω-dicarboxylic acids as component (m3). In this case, it is possible to use the esters of the abovementioned aromatic 1,ω-dicarboxylic acids individually or else as a mixture of two or more esters of the aromatic 1,ω-dicarboxylic acids.

In addition, it is also possible to use a mixture of at least one aromatic 1,ω-dicarboxylic acid and at least one ester of an aromatic 1,ω-dicarboxylic acid.

In order to obtain the aliphatic-aromatic polyester (B) in the polymerization at least of the monomers m ((m1), (m2), (m3)), at least one chain extender (CE) is optionally used.

Component (CE)

The terms "at least one chain extender (CE)", "chain extender (CE)", "chain extender" and "component (CE)" are used synonymously in the context of the present invention and have the same meaning. In addition, in the context of the present invention, the term "at least one chain extender (CE)" is understood to mean exactly one chain extender (CE) and mixtures of two or more chain extenders (CE). In a preferred embodiment, in the process of the invention, exactly one chain extender (CE) is used.

The at least one chain extender (CE) is preferably selected from the group consisting of compounds comprising at least three groups capable of ester formation (CE1) and of compounds comprising at least two isocyanate groups (CE2).

The compounds (CE1) preferably comprise 3 to 10 functional groups capable of forming ester bonds. Particularly preferred compounds (CE1) have 3 to 6 functional groups of this kind in the molecule, especially 3 to 6 hydroxyl groups and/or carboxyl groups.

Examples of the compounds (CE1) are tartaric acid, citric acid, malic acid, trimethylolpropane, trimethylolethane, pentaerythritol, polyether triols, glycerol, trimesic acid, trimellitic acid, trimellitic anhydride, pyromellitic acid, pyromellitic dianhydride or hydroxyisophthalic acid.

In general, the compounds (CE1) are used in amounts of 0.01 to 15 mol %, preferably of 0.05 to 10 mol %, more preferably of 0.1 to 4 mol %, based on the sum total of the molar amounts of components (m2) and (m3).

The compounds (CE2) preferably comprise a diisocyanate or a mixture of different diisocyanates. It is possible to use aromatic or aliphatic diisocyanates. But it is also possible to use higher-functionality isocyanates.

In the context of the present invention, an "aromatic diisocyanate" is understood to mean, in particular, tolylene 2,4-diisocyanate, tolylene 2,6-diisocyanate, diphenylmethane 2,2'-diisocyanate, diphenylmethane 2,4'-diisocyanate, diphenylmethane 4,4'-diisocyanate, naphthylene 1,5-diisocyanate or xylylene diisocyanate.

In the context of the present invention, preferred aromatic diisocyanates are diphenylmethane 2,2'-diisocyanate, diphenylmethane 2,4'-diisocyanate and diphenylmethane 4,4'-diisocyanate; particular preference is given to using these diphenylmethane diisocyanates as mixtures.

Preferably, the compounds (CE2) comprise up to 5% by weight, based on the total weight of the compounds (CE2), of urethione groups. These serve, for example, to cap the isocyanate groups.

The compounds (CE2) may also comprise a tricyclic aromatic diisocyanate. One example of a tricyclic aromatic isocyanate is tri(4-isocyanophenyl)methane. The polycyclic aromatic diisocyanates are obtained, for example, in the preparation of mono- or bicyclic aromatic diisocyanates.

An "aliphatic diisocyanate" in the context of the present invention is understood to mean, in particular, linear or branched alkylene diisocyanates or cycloalkylene diisocyanates having 2 to 20 carbon atoms, preferably 3 to 12 carbon atoms, for example hexamethylene 1,6-diisocyanate, pentamethylene 1,5-diisocyanate, isophorone diisocyanate or methylenebis(4-isocyanatocyclohexane). Particularly preferred aliphatic diisocyanates are hexamethylene 1,6-diisocyanate, pentamethylene 1,5-diisocyanate and isophorone diisocyanate.

But it is also possible to use aliphatic diisocyanates based on n-hexamethylene diisocyanate, for example cyclic trimers, pentamers or higher oligomers of n-hexamethylene diisocyanate.

Preference is given to using the compounds (CE2) in amounts of 0.01 to 5 mol %, preferably in amounts of 0.05 to 4 mol %, more preferably in amounts of 0.1 to 4 mol %, based on the sum total of the molar amounts of components m1), m2) and m3).

For the preparation of the at least one aliphatic-aromatic polyester (B) used in accordance with the invention, typical reaction conditions and catalysts are known in principle to those skilled in the art.

The at least one aliphatic-aromatic polyester (B) typically has generally a glass transition temperature $T_G$. The glass transition temperature $T_G$ of the at least one aliphatic-aromatic polyester (B) is typically in the range from −50 to 0° C., preferably in the range from −45 to −10° C. and especially preferably in the range from −40 to −20° C., determined by DSC.

The weight-average molecular weight ($M_w$) of the at least one aliphatic-aromatic polyester (B) is typically in the range from 50 000 to 300 000 g/mol, preferably in the range from 50 000 to 150 000 g/mol, determined by means of gel permeation chromatography (GPC) (size exclusion chromatography (SEC)). The solvent used was 1,1,1,3,3,3-hexafluoro-2-propanol against narrow-distribution polymethylmethacrylate (PMMA) standards.

The at least one aliphatic-aromatic polyester (B) generally has a melting temperature ($T_M$) in the range from 90 to 150° C., preferably in the range from 100 to 140° C., determined by dynamic differential calorimetry (differential scanning calorimetry; DSC).

Component (C)

Component (C) is at least one additive.

In the process for producing dyed mixed fibres (D-MF), dyed mixed fibre yarns (D-MY) and/or dyed mixed fibre textile fabrics (D-MT) the amount of the at least one additive (C) comprised in the at least one polyester fibre (PF) is generally in the range of 0 to 5% by weight, preferably in the range of 0 to 1.5% by weight, based on the total weight of the components (A), (B) and optionally (C) comprised in the at least one polyester fibre (PF), preferably based on the total weight of the at least one polyester fibre (PF).

The terms "at least one additive (C)", "additive (C)", "additive" and "component (C)" are used synonymously in the context of the present invention and have the same meaning. In addition, in the context of the present invention, the term "at least one additive (C)" is understood to mean exactly one additive (C) and mixtures of two or more additives (C).

Suitable additives (C) are known to those skilled in the art.

Examples of additives (C) are lubricants, nucleating agents, compatibilizers, flame retardants, reinforcing materials, plasticizers, antioxidants, UV stabilizers, mineral fillers and pigments.

The present invention thus also provides a process in which component (C) is selected from the group consisting of lubricants, nucleating agents, compatibilizers, flame retardants, reinforcing materials, plasticizers, antioxidants, UV stabilizers, mineral fillers and pigments.

In the context of the present invention, preference is given to using lubricants, nucleating agents and/or compatibilizers.

Useful lubricants or else mold release agents have been found to be especially hydrocarbons, fatty alcohols, higher carboxylic acids, metal salts of higher carboxylic acids, such as calcium stearate or zinc stearate, fatty acid amides, such as erucamide, and wax types, for example paraffin waxes, beeswaxes or montan waxes. Preferred lubricants are erucamide and/or wax types, and more preferably combinations of these lubricants. Preferred wax types are beeswaxes and ester waxes, especially glycerol monostearate or dimethylsiloxane or polydimethylsiloxane, for example Belzil and DM® from Waga. By virtue of the addition of the lubricants prior to the chain extension, it is possible to partly bind the lubricants to the polymer chain. In this way, it is possible to effectively prevent premature exudation of lubricants out of the finished polymer compound.

Useful nucleating agents generally include inorganic compounds such as talc, chalk, mica, silicon oxides or barium sulfate. In the production of the dyed mixed fibres (D-MF), dyed mixed fibre yarns (D-MY) and/or dyed mixed fibre textile fabrics (D-MT) of the invention, aromatic polyesters in particular, such as polyethylene terephthalate and especially polybutylene terephthalate, have been found to be advantageous.

In a preferred embodiment, the at least one polyester fibre (PF) is prepared by a process comprising the steps of (i) providing a spinnable composition (sC) comprising
  - 80 to 99.5% by weight of at least one terephthalate polyester (A),
  - 0.5 to 20% by weight of at least one aliphatic-aromatic polyester (B) and
  - 0 to 5% by weight of at least one additive (C),
  - wherein the % by weight are based in each case on the total weight of the components (A), (B) and optionally (C), preferably on the total weight of the spinnable composition (sC), and (ii) extruding the spinnable composition (sC) through at least one spinneret in order to obtain the at least one polyester fibre (PF).

Step (I)

In step (i) the spinnable composition (sC) is provided.

In a preferred embodiment, the process for the preparation of the at least one polyester fibre (PF) according to the invention is conducted in an extruder comprising at least one mixing segment and at least one conveying segment. The mixing segment generally comprises at least one mixing element; the conveying segment generally comprises at least one conveying element. In addition, the extruder used with preference in the process of the invention comprises at least one spinneret.

Suitable spinnerets, conveying elements and mixing elements are known to those skilled in the art. Preference is given to using single-screw extruders, twin-screw extruders static mixers or melt pumps since homogeneous mixing can be achieved via the length and type of screw, temperature and residence time in the extruder. The extruder may, as well as the at least one mixing segment, the at least one conveying segment and the at least one spinneret, have backup zones and venting zones. The extruder used with preference in the process of the invention thus comprises at least one mixing segment followed by at least one conveying segment, with the at least one spinneret following on from the at least one conveying segment.

In step (i) the spinnable composition (sC) is generally provided in an extruder. In one embodiment the ready mixed spinnable composition (sC) is fed to the extruder. Therefore, the components (A), (B) and optionally (C) can be mixed in an external mixing device in order to obtain the spinnable composition (sC) which can be subsequently fed to the extruder.

In a preferred embodiment, step (i) is conducted in an extruder, preferably in the at least one mixing segment of the extruder. In other word the process for the preparation of the spinnable composition (sC) is conducted in an extruder, preferably in the at least one mixing segment of the extruder.

Preferably in the at least one mixing segment, components (A), (B) and optionally (C) are then mixed to obtain the spinnable composition (sC). From the at least one mixing segment, the spinnable composition (sC), in a preferred embodiment, passes into the at least one conveying segment (in this regard, see also step (ii) below).

In one embodiment in step (i), the at least one terephthalate polyester (A), the at least one aliphatic-aromatic polyester (B) and optionally the at least one additive (C) are metered into the extruder, for example in granular or already melt form, preferably using corresponding metering devices. Components (A), (B) and optionally (C) can either be metered together to the extruder or component (A) can be metered to the extruder first and then component (B) and optionally component (C) can be metered.

In the mixing segment of the extruder, components (A), (B) and optionally (C) are preferably mixed with one another, optionally by heating until a melt is obtained. The temperature in step (i) is chosen by the person skilled in the art and is guided by the nature of components (A), (B) and optionally (C).

The at least one terephthalate polyester (A) and the at least one aliphatic-aromatic polyester (B) should on the one hand soften to a sufficient degree that mixing and conveying is possible. On the other hand, they should not become too mobile because it is otherwise not possible to introduce sufficient shear energy and, under some circumstances, there is also a risk of thermal degradation.

The temperature in step (i) generally depends on the component (A) used. Preferably step (i) is conducted at a temperature of 230 to 290° C., preferably at a temperature of 270 to 280° C. In a preferred embodiment, the temperature in step (i) is measured at the extruder shell that surrounds the mixing segment.

Step (ii)

In step (ii), the spinnable composition (cS), obtained in step (i), preferably in form of a melt, is extruded through at least one spinneret to obtain the at least one polyester fibre (PF).

In a preferred embodiment, the spinnable composition (cS) obtained in step (i) passes from the at least one mixing segment of the extruder into the at least one conveying segment of the extruder. From the at least one conveying segment, the spinnable composition (cS) then subsequently preferably passes to the at least one spinneret through which it is extruded. Preferably, the spinnable composition (cS) obtained is extruded through multiple spinnerets to obtain the at least one polyester fibre (PF).

Preferably, step (ii) is conducted in the same extruder as step (i).

The person skilled in the art is aware in principle of how the extrusion through the at least one spinneret is conducted. The at least one spinneret is preferably a perforated die, for example a 24-hole die with a normal sieve. The spinneret may be varied depending on fibre type and the targeted single filament fibre diameter and shape.

The fibre can be drawn from the at least one spinneret at a speed that partially orients the at least one polyester fibre (PF). Optionally, the at least one polyester fibre (PF) can be fully drawn from the at least one spinneret with an additional drawing step when heat is applied. The at least one polyester fibre (PF) can, for example, be collected on a spool. In one preferred embodiment, the at least one polyester fibre (PF) can be texturized before cutting.

According to the invention the aforementioned preferred embodiment and preferences in view of the process for the preparation of the at least one polyester fibre (PF) are preferably combined with the aforementioned description and preferences in view of the components (A) to (C).

Step b)

In step b) of the process for producing dyed mixed fibres (D-MF), dyed mixed fibre yarns (D-MY) and/or dyed mixed fibre textile fabrics (D-MT), at least one further fibre (FF) different from the at least one polyester fibre (PF) is provided.

The terms "at least one further fibre (FF)", "further fibre (FF)" and "further fibre" are used synonymously in the context of the present invention and have the same meaning. Furthermore, in the context of the present invention, the term "at least one further fibre (FF)" is understood to mean exactly one further fibre (FF) and mixtures of two or more further fibres (FF). In a preferred embodiment, mixtures of two or more further fibres (FF) are used in the process of the invention.

In one embodiment, in step b) at least 1% by weight, more preferably at least 5% by weight, most preferably at least 10% by weight and especially preferably at least 20% by weight of the at least one further fibre (FF) are provided, based in each case on the total weight of the at least one polyester fibre (PF) and the at least one further fibre (FF).

In a further embodiment, in step b) at most 99% by weight, more preferably at most 95% by weight, most preferably at most 90% by weight and especially preferably at most 80% by weight of the at least one further fibre (FF) are provided, based in each case on the total weight of the at least one polyester fibre (PF) and the at least one further fibre (FF).

Preferably, in step b) 1 to 99% by weight, more preferably 5 to 95% by weight, most preferably 10 to 90% by weight and especially preferably 20 to 80% by weight of the at least one further fibre (FF) are provided, based in each case on the total weight of the at least one polyester fibre (PF) and the at least one further fibre (FF).

The present invention thus also provides a process in which in step a) 1 to 99% by weight of the at least one polyester fibre (PF) and in step b) 1 to 99% by weight of the at least one further fibre (FF) are provided, based in each case on the total weight of the at least one polyester fibre (PF) and the at least one further fibre (FF).

Further Fibre (FF)

The at least one further fibre (FF) is different from the at least one polyester fibre (PF) and may be a natural fibre or a synthetic fibre.

Examples for suitable natural fibres are silk, wool and cotton fibres; examples for suitable synthetic fibres are polyamide fibres, acrylic fibres, polypropylene fibres, polyurethane fibres, viscose fibres and pure polyester fibres.

In the context of the present invention, the term "pure polyester fibre" is understood to mean a polyester fibre which is different from the at least one polyester fibre (PF) comprised in the mixed fibres (MF), the mixed fibre yarns (MY) and the mixed fibre textile fabrics (MT). The "pure polyester fibre" comprises at least one terephthalate polyester (A) and optionally at least one additive (C), and does not comprise at least one aliphatic-aromatic polyester (B). In a preferred embodiment, the "pure polyester fibre" contains 95 to 100% by weight of at least one terephthalate polyester (A) and 0 to 5% by weight of at least one additive (C), based on the total weight of the pure polyester fibre.

In a preferred embodiment, the at least one further fibre (FF) is selected from the group consisting of polyamide fibres, cotton fibres, wool fibres and viscose fibres.

The present invention thus also provides a process in which the at least one further fibre (FF) is selected from the group consisting of polyamide fibres, cotton fibres, wool fibres and viscose fibres.

The natural fibres such as the cotton fibres and wool fibres are typically staple fibres.

In the context of the present invention, the term "staple fibre" is understood to mean a fibre with a finite length. Typically, the staple fibres have a length in the range of 20 to 80 mm.

The synthetic fibres such as the polyamide fibres, acrylic fibres and polyurethane fibres are preferably filaments.

In the context of the present invention, the term "filament" is understood to mean a fibre with an infinite length. Filaments are also referred to as continuous fibres.

However, it is also possible that the natural fibres are filaments. For example, silk is a filament. Reversely, it is also possible that the synthetic fibres like viscose fibres are staple fibres. In this case, the (synthetic) filaments are cut into fibres with a finite length to obtain synthetic staple fibres.

In a preferred embodiment of the present invention, the viscose fibres, cotton fibres and wool fibres are staple fibres.

The present invention thus also provides a process in which the viscose fibres, cotton fibres and wool fibres are staple fibres.

Step c)

In step c) of the process for producing dyed mixed fibres (D-MF), dyed mixed fibre yarns (D-MY) and/or dyed mixed fibre textile fabrics (D-MT), the at least one polyester fibre (PF) and the at least one further fibre (FF) are processed to obtain mixed fibres (MF), mixed fibre yarns (MY) and/or mixed fibre textile fabrics (MT), wherein the mixed fibres (MF), the mixed fibre yarns (MY) and the mixed fibre textile fabrics (MT) comprise the at least one polyester fibre (PF) and the at least one further fibre (FF).

The term "yarn" in the context of the present invention is understood to mean a long, thin structure made from one or more fibres.

The term "textile fabric" in the context of the present invention encompasses all materials throughout the production chain of textiles, for example all kinds of textile finished products, for example all kinds of apparel, domestic textiles such as carpets, curtains, covers or pieces of furniture, or industrial textiles for industrial or commercial purposes, or textiles for domestic applications, for example cloths or wiping cloths for cleaning. The term additionally also includes the starting materials and semi-finished articles or intermediate products, for example weaves, loop-drawn knits, loop-formed knits, nonwovens or fleeces. Also encompassed by the invention are fillers and flocs for textiles, for example cushions or else stuffed toy animals.

Processes for producing mixed fibres (MF), mixed fibre yarns (MY) and/or mixed fibre textile fabrics (MT) are known in principle to those skilled in the art.

In a preferred embodiment, the mixed fibres (MF) are manufactured by twisting staple fibres of the at least one polyester fibre (PF) and the at least one further fibre (FF). It is clear for a skilled person that, before twisting, in case the at least one polyester fibre (PF) and/or the at least one further fibre (FF) are filaments, the filaments are cut into fibres with a finite length to obtain staple fibres.

In another preferred embodiment, in case the at least one further fibre (FF) is also a synthetic fibre, the mixed fibres (MF) are manufactured during the preparation process of the respective fibres. In this case, the at least one polyester fibre (PF) and the at least one further fibre (FF) are mixed and spun in the molten state when coming out of the respective spinnerets.

The mixed fibre yarns (MY) are preferably manufactured by pulling the mixed fibres (MF) and collecting them on a bobbin.

The mixed fibre textile fabrics (MT) are for example manufactured by weaving, wherein the at least one polyester fibre (PF) and the at least one further fibre (FF) may be weaved, a mixed fibre yarn (MY) may be weaved or a yarn comprising the at least one polyester fibre (PF) and a yarn comprising the at least one further fibre (FF) may be weaved. Further, the mixed fibre textile fabrics (MT) can be manufactured by combining semi-finished articles or intermediate articles comprising the at least one polyester fibre (PF) with semi-finished articles or intermediate articles comprising the at least one further fibre (FF). Processes for producing semi-finished articles or intermediate articles from (mixed) fibres and/or (mixed) yarns are also known to those skilled in the art.

Step d)

In step d) of the process for producing dyed mixed fibres (D-MF), dyed mixed fibre yarns (D-MY) and/or dyed mixed fibre textile fabrics (D-MT), the mixed fibres (MF), the mixed fibre yarns (MY) and/or the mixed fibre textile fabrics (MT) are contacted simultaneously with at least two different dyes (D1) and (D2) at a temperature $T_D$<130° C.

In the context of the present invention, the terms "simultaneous contacting" and "simultaneously contacted" are understood to mean that the mixed fibres (MF) are contacted with at least two different dyes (D1) and (D2) at the same time and/or that the mixed fibre yarns (MY) are contacted with at least two different dyes (D1) and (D2) at the same time and/or that mixed fibre textile fabrics (MT) are contacted with at least two different dyes (D1) and (D2) at the same time.

The simultaneous contacting of the mixed fibres (MF), the mixed fibre yarns (MY) and/or the mixed fibre textile fabrics (MT) with the at least two different dyes (D1) and (D2) is preferably carried out by immersing the mixed fibres (MF), the mixed fibre yarns (MY) and/or the mixed fibre textile fabrics (MT) into a bath. In a preferred embodiment, the simultaneous contacting of the mixed fibres (MF), the mixed fibre yarns (MY) and/or the mixed fibre textile fabrics (MT) with the at least two different dyes (D1) and (D2) is carried out by immersing the mixed fibres (MF), the mixed fibre yarns (MY) and/or the mixed fibre textile fabrics (MT) at least once into a bath.

In the context of the present invention, the term "at least once" is understood to mean exactly once as well as two or more times.

The bath preferably comprises water and the at least two different dyes (D1) and (D2).

The present invention thus also provides a process in which the simultaneous contacting of the mixed fibres (MF), the mixed fibre yarns (MY) and/or the mixed fibre textile fabrics (MT) with the at least two different dyes (D1) and (D2) is carried out by immersing the mixed fibres (MF), the mixed fibre yarns (MY) and/or the mixed fibre textile fabrics (MT) at least once into a bath and wherein the bath comprises water and the at least two different dyes (D1) and (D2).

The simultaneous contacting of the mixed fibres (MF), the mixed fibre yarns (MY) and/or the mixed fibre textile fabrics (MT) with the at least two different dyes (D1) and (D2) is carried out at a temperature $T_D$<130° C., preferably at a temperature $T_D$<110° C. and more preferably at a temperature $T_D$<100° C. In a preferred embodiment, the bath into which the mixed fibres (MF), the mixed fibre yarns (MY) and/or the mixed fibre textile fabrics (MT) are preferably immersed has the temperature $T_D$<130° C., preferably the temperature $T_D$<110° C. and more preferably the temperature $T_D$<100° C.

The present invention thus also provides a process in which the mixed fibres (MF), the mixed fibre yarns (MY) and/or the mixed fibre textile fabrics (MT) are simultaneously contacted with the at least two different dyes (D1) and (D2) at a temperature $T_D$<110° C.

Furthermore, the present invention thus also provides a process in which the mixed fibres (MF), the mixed fibre yarns (MY) and/or the mixed fibre textile fabrics (MT) are simultaneously contacted with the at least two different dyes (D1) and (D2) at a temperature $T_D$<100° C.

Preferably, the simultaneous contacting of the mixed fibres (MF), the mixed fibre yarns (MY) and/or the mixed fibre textile fabrics (MT) with the at least two different dyes (D1) and (D2) is carried out at a pressure of 1 to 4.5 bar, more preferably at a pressure of 1 to 3 bar and most preferably at a pressure of 1 to 2.8 bar.

In a preferred embodiment, the simultaneous contacting of the mixed fibres (MF), the mixed fibre yarns (MY) and/or the mixed fibre textile fabrics (MT) with the at least two different dyes (D1) and (D2) is carried out at a temperature $T_D$<130° C. and at a pressure of 2.7 bar.

The mixed fibres (MF), the mixed fibre yarns (MY) and/or the mixed fibre textile fabrics (MT) may be simultaneously contacted with the at least two different dyes (D1) and (D2) for a period of 10 to 120 minutes.

The at least two different dyes (D1) and (D2) are preferably selected from direct, vat and disperse dyes.

In the context of the present invention, the term "direct dye" is understood to mean a coloured polar water-soluble compound which is, during the dyeing process, attracted by physical forces at the molecular level to the fibre. Direct dyes generally carry a negative or a positive charge and are therefore also referred to as cationic or anionic dyes. Direct dyes are preferably applicable on cotton, viscose, polyamide and wool fibres.

Examples for direct dyes are azo dyes, dioxazine dyes, sulphur dyes and non azo metal complex dyes. A suitable direct dye for the inventive process is for example direct red 80.

In the context of the present invention, the term "vat dye" is understood to mean a coloured water-insoluble compound which is, during the dyeing process, reduced and made water-soluble, and can thus be absorbed by the fibre. The vat dye generally reacts with the fibre or is made water-insoluble again by oxidation. Vat dyes are preferably applicable on cotton fibres.

Examples for vat dyes are indigoid compounds and leuco compounds of anthraquinoid dyes and sulphur dyes. A suitable vat dye for the inventive process is for example indigo.

In the context of the present invention, the term "disperse dye" is understood to mean a coloured non-polar compound which has very low water solubility. During the dyeing process the disperse dye generally diffuses into the fibre, where it forms a solid solution. Disperse dyes are preferably applicable on polyester fibres.

Examples for disperse dyes are azobenzene or anthraquinone molecules with nitro, amine, and hydroxyl groups. A suitable disperse dye for the inventive process is for example disperse blue 139.

The present invention thus also provides a process in which the at least two different dyes (D1) and (D2) are selected from anionic, cationic, vat and disperse dyes.

Preferably, the dye (D1) dyes the at least one polyester fibre (PF) and the dye (D2) dyes the at least one further fibre (FF) in the dyed mixed fibres (D-MF), the dyed mixed fibre yarns (D-MY) and/or the dyed mixed fibre textile fabrics (D-MT).

The present invention thus also provides a process in which the dye (D1) dyes the at least one polyester fibre (PF) and the dye (D2) dyes the at least one further fibre (FF) in the dyed mixed fibres (D-MF), the dyed mixed fibre yarns (D-MY) and/or the dyed mixed fibre textile fabrics (D-MT).

The dye (D1) which preferably dyes the at least one polyester fibre (PF) is preferably a disperse dye. The dye (D2) which preferably dyes the at least one further fibre (FF) is preferably a direct or a vat dye.

The mixed fibres (MF), the mixed fibre yarns (MY) and/or the mixed fibre textile fabrics (MT) can also simultaneously be contacted with further components. Examples for further components are dispersing agents and aftersoaping agents.

Suitable dispersing agents are for example available under the trade name Avolan® IS and Levegal® DLP.

Suitable aftersoaping agents are Foryl 197 and Cotoblanc LNS.

In case, the mixed fibres (MF), the mixed fibre yarns (MY) and/or the mixed fibre textile fabrics (MT) are simultaneously be contacted with further components, the mixed fibres (MF) are contacted with the further components and the at least two different dyes (D1) and (D2) at the same time and/or the mixed fibre yarns (MY) are contacted with the further components and the at least two different dyes (D1) and (D2) at the same time and/or the mixed fibre textile fabrics (MT) are contacted with the further components and the at least two different dyes (D1) and (D2) at the same time.

In a preferred embodiment, the further components are also comprised in a bath in which the mixed fibres (MF), the mixed fibre yarns (MY) and/or the mixed fibre textile fabrics (MT) are immersed.

In step d), the dyed mixed fibres (D-MF), the dyed mixed fibre yarns (D-MY) and/or the dyed mixed fibre textile fabrics (D-MT) are obtained.

The present invention thus also provides dyed mixed fibres (D-MF), dyed mixed fibre yarns (D-MY) and/or dyed mixed fibre textile fabrics (D-MT) obtained by this process.

The invention is explained in more detail below by examples, but is not restricted thereto.

EXAMPLES

Mixed Fibre Textile Fabrics (MT) Comprising a Cotton Fibre as Further Fibre (FF)

Inventive Example E1

A mixed fibre textile fabric (MT) of the following types of fibre was immersed in a dyeing bath 1:

Fibre 1

Polyester fibre (PF) comprising

93% by weight of polyethylene terephthalate (Component (A)) and 7% by weight of an aliphatic-aromatic polyester (Component (B)) (obtained by polymerization of 50% by weight of butane-1,4-diol (Component (m1)), 26% by weight of adipic acid (Component (m2)) and 24% by weight of terephthalic acid (Component ($m^3$)))

Fibre 2

Cotton fibre (Further fibre (FF))

The mixed fibre textile fabric (MT) of fibre 1 and fibre 2 was manufactured by combining 50 wt.-% of a textile fabric of fibre 1 and 50 wt.-% of a textile fabric of fibre 2, based on the total weight of the textile fabric of fibre 1 and the textile fabric of fibre 2.

The dyeing bath 1 comprises water, 1 wt.-% Disperse dye Blue 139 (dye (D1), dyes the polyester fibre (PF)) and 1 wt.-% Sirius Red F3B (dye (D2), direct dye, dyes the cotton fibre). Further, the dyeing bath 1 comprises 2 g/L aftersoaping agent and 0.5 g/L Avolan IS. The weight-ratio of the mixed textile fabric (MT) to bath was 1:50.

The mixed fibre textile fabric (MT) was immersed in the dyeing bath 1 which was heated to a temperature $T_D$, where 100° C.<$T_D$<130° C., held for 1 hour and cooled down to 100° C. Then $Na_2SO_4$ was added and the dyeing was continued for 30 minutes. After that, the mixed fibre textile fabric (MT) was rinsed with water three times: one time with warm water, one time with cold water and finally with cold water comprising 1 mL/L acetic acid (80%).

Inventive Example E2

A mixed fibre textile fabric (MT) of the following types of fibre was immersed in a dyeing bath 1:

Fibre 1 and

Fibre 2 as described in E1. The mixed fibre textile fabric (MT) of fibre 1 and fibre 2 was also manufactured as described in E1. The dyeing bath 1 is also the same as described in E1. The weight-ratio of the mixed textile fabric (MT) to bath was 1:50.

The mixed fibre textile fabric (MT) was immersed in the dyeing bath 1 which was heated to a temperature $T_D$, where $T_D$<100° C., and held for 1 hour. Then $Na_2SO_4$ was added and the dyeing was continued for 30 minutes. After that, the mixed fibre textile fabric (MT) was rinsed with water three times: one time with warm water, one time with cold water and finally with cold water comprising 1mL/L acetic acid (80%).

Inventive Example E3

A mixed fibre textile fabric (MT) of the following types of fibre was immersed in a dyeing bath 2:

Fibre 1 and

Fibre 2 as described in E1. The mixed fibre textile fabric (MT) of fibre 1 and fibre 2 was also manufactured as described in E1.

The dyeing bath 2 comprises water and 1 wt.-% Disperse dye Blue 139 (dye (D1)). Further, it comprises 2 g/L aftersoaping agent and 0.5 g/L Avolan IS. The weight-ratio of the mixed textile fabric (MT) to bath was 1:50.

The mixed fibre textile fabric (MT) was immersed in the dyeing bath 2, which was heated to a temperature $T_D$, where $T_D$<100° C., and held for 1 hour. Subsequently, 1 wt.-% Sirius Red F3B (dye (D2), direct dye) was added to the dyeing bath 2 and dyeing was continued for 20 minutes. Then, $Na_2SO_4$ was added and the dyeing was continued for 30 minutes. After that, the mixed fibre textile fabric (MT) was rinsed with water three times: one time with warm water, one time with cold water and finally with cold water comprising 1mL/L acetic acid (80%).

Comparative Example (C4)

A mixed fibre textile fabric (MT) of the following types of fibre was immersed in a dyeing bath 1:

Fibre 2

Cotton fibre (Further fibre (FF))

Fibre 3

Pure polyethylene terephthalate (PET) fibre

The mixed fibre textile fabric (MT) of fibre 2 and fibre 3 was manufactured by combining 50 wt.-% of a textile fabric of fibre 3 and 50 wt.-% of a textile fabric of fibre 2, based on the total weight of the textile fabric of fibre 3 and the textile fabric of fibre 2.

The dyeing bath 1 is the same as described in E1. The weight-ratio of the mixed textile fabric (MT) to bath was 1:50.

The mixed fibre textile fabric (MT) was immersed in the dyeing bath 1 which was heated to a temperature $T_D$, where 100° C.<$T_D$<130° C., held for 1 hour and cooled down to 100° C. Then $Na_2SO_4$ was added and the dyeing was continued for 30 minutes. After that, the mixed fibre textile fabric (MT) was rinsed with cold water three times: one time with warm water, one time with cold water and finally with cold water comprising 1 mL/L acetic acid (80%).

After contacting the mixed fibre textile fabrics (MT) with the dyes, their colour depths (K/S) were analysed after drying the fibre textile fabrics to air. The results are listed in table 1.

The colour depths (K/S) were determined according to the Kubelka-Monk Theory. They indicate the colour intensity at a specific wavelength λ compared to a Blanco sample. The Blanco sample is a respective fibre textile fabric not immersed in a dyeing bath. The specific wavelength λ for Disperse dye Blue 139 is 620 nm and the specific wavelength λ for Sirius Red F3B is 360 nm.

The mixed fibre textile fabrics (MT) were analyzed directly after removal from the dyeing bath. "Directly" after removal from the dyeing bath means that the mixed fibre textile fabrics (MT) were washed with water three times: one time with warm water, one time with cold water and finally with cold water containing 1 mL/L acetic acid (80%).The samples were subsequently dried to air.

TABLE 1

| Example | Temperature $T_D$ [° C.] | K/S Textile fabric of fibre 1 directly (blue) | K/S Textile fabric of fibre 2 directly (red) | K/S Textile fabric of fibre 3 directly (blue) |
|---|---|---|---|---|
| E1 | 100° C. < $T_D$ < 130° C. | 8.0698 | 1.4501 | — |
| E2 | $T_D$ < 100° C. | 6.1214 | 1.6453 | — |

TABLE 1-continued

| Example | Temperature $T_D$ [° C.] | K/S Textile fabric of fibre 1 directly (blue) | K/S Textile fabric of fibre 2 directly (red) | K/S Textile fabric of fibre 3 directly (blue) |
|---|---|---|---|---|
| E3 | $T_D$ < 100° C. | 5.9858 | 1.4844 | — |
| C4 | 100° C. < $T_D$ < 130° C. | — | 1.5295 | 3.7930 |

From table 1, especially from inventive examples E1 and E2, it can clearly be seen that, by the inventive process, mixed fibre textile fabrics (MT) which comprise the polyester fibre (PF) and a cotton fibre as the further fibre (FF) can be dyed simultaneously with at least two different dyes (D1) and (D2) in one step at a temperature $T_D$<130° C.

It can also be seen that at a temperature $T_D$<100° C., the cotton fibres show a higher dye uptake (K/S=1.6453) than at a temperature $T_D$, where 100° C.<$T_D$<130° C. (K/S=1.4501). In addition, by comparing inventive example E2 to inventive example E3, it is evident that the dye uptake is higher by simultaneously contacting the mixed fibre textile fabrics (MT) with the dyes (D1) and (D2) in one step than by first contacting the mixed fibre textile fabrics (MT) with the dye (D1) and subsequently with the dyes (D1) and (D2).

By comparing comparative example C4 to inventive examples E1 to E3, it can be seen that by using a pure polyethylene terephthalate (PET) fibre, instead of the polyester fibre (PF), in the mixed fibre textile fabrics (MT), a lower dye uptake is observed, especially for the polyethylene terephthalate (PET) fibre.

The colour fastness to washing at 60° C. according to ISO 105 C06 C1S was also tested. The results are summarized in table 2. Assessment is on a scale from 1 to 5, the higher the value, the lower the staining of the textile fabric in the standard specimen. From this, inferences can be drawn about the colour fastness of the particular mixed fibre textile fabric (MT) tested.

The particular mixed fibre textile fabric (MT) is kept between a piece of textile fabric of cotton and a piece of textile fabric of undyed fibres 1, 2 or 3. The staining of the various fibres was assessed by visual inspection. The staining of the blue and red fibres was tested separately.

TABLE 2

| Example | Temperature $T_D$ [° C.] | Change in hue | Cotton | Fibre 1 undyed | Fibre 2 undyed | Fibre 3 undyed |
|---|---|---|---|---|---|---|
| E1 (blue) | 100° C. < $T_D$ < 130° C. | 4/5 | 4/5 | 4/5 | | — |
| E1 (red) | 100° C. < $T_D$ < 130° C. | 2/3 | 4 | — | 4/5 | — |
| E2 (blue) | $T_D$ < 100° C. | 4/5 | 4/5 | 4 | — | — |
| E2 (red) | $T_D$ < 100° C. | 3 | 4 | — | 3 | — |
| C4 (blue) | 100° C. < $T_D$ < 130° C. | 4/5 | 4/5 | — | — | 4/5 |
| C4 (red) | 100° C. < $T_D$ < 130° C. | 2/3 | 4 | — | 4/5 | — |

As is clearly apparent from table 2, the textiles which are dyed according to the present invention at lower temperatures show similar colour fastness properties as the textiles comprising pure PET, which were dyed at 130° C.

Mixed Fibre Textile Fabrics (MT) Comprising a Wool Fibre as Further Fibre (FF)

Inventive Example E5

A mixed fibre textile fabric (MT) of the following types of fibre was immersed in a dyeing bath 3:

Fibre 1

Polyester fibre (PF) comprising

93% by weight of polyethylene terephthalate (Component (A)) and

7% by weight of an aliphatic-aromatic polyester (Component (B)) (obtained by polymerization of 50% by weight of butane-1,4-diol (Component (m1)), 26% by weight of adipic acid (Component (m2)) and 24% by weight of terephthalic acid (Component ($m^3$)))

Fibre 4

Wool fibre (Further fibre (FF))

The mixed fibre textile fabric (MT) of fibre 1 and fibre 4 was manufactured by combining 50 wt.-% of a textile fabric of fibre 1 and 50 wt.-% of a textile fabric of fibre 4, based on the total weight of the textile fabric of fibre 1 and the textile fabric of fibre 4.

The dyeing bath 3 comprises 1 wt.-% Disperse dye Blue 139 (dye (D1), dyes the polyester fibre (PF)), 1.55 wt.-% Nylosan Red N-2RBL (dye (D2), direct dye, dyes the wool fibre), 5 wt.-% sodium sulphate, 0.3 wt.-% pick up improver, 1 wt.-% polyacrylamide derivative and 0.25 wt.-% alcohol polyglycol ether, and the balance up to 100% is water. Further, the dyeing bath 3 comprises 0.5 g/L Avolan IS, 2 g/L aftersoaping agent, 0.16 g/L Levegal THE, 0.5 g/L $NaH_2PO_4$ and 1 g/L sodium acetate.

The weight ratio of textile to bath was 1:50.

The mixed fibre textile fabric (MT) was immersed in the dyeing bath 3 which was heated to a temperature $T_D$=90° C. and held for 1 hour. Then $Na_2SO_4$ was added and the dyeing was continued for 30 minutes. After that, the mixed fibre textile fabric (MT) was rinsed with cold water three times: one time with warm water, one time with cold water and finally with cold water comprising 1 mL/L acetic acid (80%).

Comparative Example C6

A mixed fibre textile fabric (MT) of the following types of fibre was immersed in a dyeing bath 3:

Fibre 3

Pure polyethylene terephthalate (PET) fibre

Fibre 4

Wool fibre (Further fibre (FF)) The mixed fibre textile fabric (MT) of fibre 3 and fibre 4 was manufactured by combining 50 wt.-% of a textile fabric of fibre 3 and 50 wt.-% of a textile fabric of fibre 4, based on the total weight of the textile fabric of fibre 3 and the textile fabric of fibre 4. The weight ratio of textile to bath was 1:50.

The fibre textile fabric (MT) was immersed in the dyeing bath 3 which was heated to a temperature $T_D$=90° C. and held for 1 hour. Then $Na_2SO_4$ was added and the dyeing was continued for 30 minutes. After that, the mixed fibre textile fabric (MT) was rinsed with cold water three times: one time with warm water, one time with cold water and finally with cold water comprising 1 mL/L acetic acid (80%).

After contacting the (mixed) fibre textile fabrics with the dyes, their colour depths (K/S) were analysed directly after removal from the dyeing bath. The results are listed in table 3.

"Directly" after removal from the dyeing bath means that the mixed fibre textile fabrics (MT) were washed with water three times: one time with warm water, one time with cold water and finally with cold water comprising 1 mL/L acetic acid (80%). The samples were subsequently dried to air.

The colour depths (K/S) were determined as described above. The specific wavelength λ for Nylosan Red N-2RBL is 520 nm.

TABLE 3

| Example | Temperature $T_D$ [° C.] | K/S Textile fabric of fibre 1 directly (blue) | K/S Textile fabric of fibre 4 directly (red) | K/S Textile fabric of fibre 3 directly (blue) |
|---|---|---|---|---|
| E5 | 90 | 3.0364 | 12.893 | — |
| C6 | 90 | — | 12.904 | 1.2615 |

From table 2, it can clearly be seen that, by the inventive process, fibre textile fabrics (MT) which comprise the polyester fibre (PF) and a wool fibre as the further fibre (FF) can be dyed simultaneously with at least two different dyes (D1) and (D2) in one step at a temperature $T_D$<100° C.

The invention claimed is:

1. A process for producing dyed mixed fibers (D-MF), dyed mixed fiber yarns (D-MY) and/or dyed mixed fiber textile fabrics (D-MT) comprising the following steps a) to d)

a) providing at least one polyester fiber (PF) comprising 80 to 99.5% by weight of at least one terephthalate polyester (A), 0.5 to 20% by weight of at least one aliphatic-aromatic polyester (B) obtained by polymerization of at least the following monomers:
   (m1) at least one aliphatic 1,ω-diol,
   (m2) at least one aliphatic 1,ω-dicarboxylic acid compound and
   (m3) at least one aromatic 1,ω-dicarboxylic acid compound, and
   0 to 5% by weight of at least one additive (C),
   wherein the % by weight are based in each case on the total weight of components (A), (B) and optionally (C), b) providing at least one further fiber (FF) different from the at least one polyester fiber (PF), c) processing the at least one polyester fiber (PF) and the at least one further fiber (FF) to obtain mixed fibers (MF), mixed fiber yarns (MY) and/or mixed fiber textile fabrics (MT), wherein the mixed fibers (MF), the mixed fiber yarns (MY) and the mixed fiber textile fabrics (MT) comprise the at least one polyester fiber (PF) and the at least one further fiber (FF), and d) contacting the mixed fibers (MF), the mixed fiber yarns (MY) and/or the mixed fiber textile fabrics (MT) simultaneously with at least two different dyes (D1) and (D2) at a temperature $TD_D$<130° C. to obtain dyed mixed fibers (D-MF), dyed mixed fiber yarns (D-MY) and/or dyed mixed fiber textile fabrics (D-MT).

2. The process according to claim 1, wherein the at least two different dyes (D1) and (D2) are selected from anionic, cationic, vat and disperse dyes.

3. The process according to claim 1, wherein the at least one terephthalate polyester (A) is at least one polyester selected from the group consisting of polyethylene terephthalate (PET), polytrimethylene terephthalate (PTT) and polybutylene terephthalate (PBT).

4. The process according to claim 1, wherein the at least one aliphatic 1,ω-diol (m1) is butane-1,4-diol.

5. The process according to claim 1, wherein the at least one aliphatic 1,ω-dicarboxylic acid compound (m2) is selected from the group consisting of succinic acid, adipic acid and sebacic acid.

6. The process according to claim 1, wherein the at least one aromatic 1,ω-dicarboxylic acid compound (m3) is terephthalic acid or dimethyl terephthalate.

7. The process according to claim 1, wherein the at least one further fiber (FF) is selected from the group consisting of polyamide fibers, cotton fibers, wool fibers and viscose fibers.

8. The process according to claim 7, wherein the viscose fibers, cotton fibers and wool fibers are staple fibers.

9. The process according to claim 1, wherein in step a) 1 to 99% by weight of the at least one polyester fiber (PF) and in step b) 1 to 99% by weight of the at least one further fiber (FF) are provided, based in each case on the total weight of the at least one polyester fiber (PF) and the at least one further fiber (FF).

10. The process according to claim 1, wherein the mixed fibers (MF), the mixed fiber yarns (MY) and/or the mixed fiber textile fabrics (MT) are simultaneously contacted with the at least two different dyes (D1) and (D2) at a temperature $TD_D$<110° C.

11. The process according to claim 1, wherein the mixed fibers (MF), the mixed fiber yarns (MY) and/or the mixed fiber textile fabrics (MT) are simultaneously contacted with the at least two different dyes (D1) and (D2) at a temperature $TD_D$<100° C.

12. The process according to claim 1, wherein the dye (D1) dyes the at least one polyester fiber (PF) and the dye (D2) dyes the at least one further fiber (FF) in the dyed mixed fibers (D-MF), the dyed mixed fiber yarns (D-MY) and/or the dyed mixed fiber textile fabrics (D-MT).

13. The process according to claim 1, wherein component (C) is selected from the group consisting of lubricants, nucleating agents, compatibilizers, flame retardants, reinforcing agents, plasticizers, antioxidants, UV stabilizers, mineral fillers and pigments.

14. The process according to claim 1, wherein the simultaneous contacting of the mixed fibers (MF), the mixed fiber yarns (MY) and/or the mixed fiber textile fabrics (MT) with the at least two different dyes (D1) and (D2) is carried out by immersing the mixed fibers (MF), the mixed fiber yarns (MY) and/or the mixed fiber textile fabrics (MT) at least once into a bath and wherein the bath comprises water and the at least two different dyes (D1) and (D2).

15. Dyed mixed fibers (D-MF), dyed mixed fiber yarns (D-MY) and/or dyed mixed fiber textile fabrics (D-MT) obtained by a process according to claim 1.

* * * * *